US010835045B2

(12) United States Patent
Olarte

(10) Patent No.: US 10,835,045 B2
(45) Date of Patent: Nov. 17, 2020

(54) CHAIR FRAME WITH INJECTION MOLDED FOAM PADDING

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 16/780,295

(22) Filed: Feb. 3, 2020

(65) Prior Publication Data

US 2020/0170412 A1 Jun. 4, 2020

Related U.S. Application Data

(62) Division of application No. 16/431,196, filed on Jun. 4, 2019, now Pat. No. 10,588,414.

(60) Provisional application No. 62/682,486, filed on Jun. 8, 2018.

(51) Int. Cl.

| | |
|---|---|
| ***A47C 5/06*** | (2006.01) |
| ***A47C 7/44*** | (2006.01) |
| ***A47C 7/62*** | (2006.01) |
| ***A47C 11/00*** | (2006.01) |
| ***A47C 7/18*** | (2006.01) |
| ***A47C 3/04*** | (2006.01) |

(52) U.S. Cl.

CPC ..... *A47C 5/06* (2013.01); *A47C 3/04* (2013.01); *A47C 7/185* (2013.01); *A47C 7/44* (2013.01); *A47C 7/622* (2018.08); *A47C 11/005* (2013.01)

(58) Field of Classification Search

CPC ..... A47C 5/06; A47C 11/005; A47C 7/622; A47C 7/44; A47C 3/04; A47C 7/185

See application file for complete search history.

(56) References Cited

U.S. PATENT DOCUMENTS

| | | | |
|---|---|---|---|
| 3,874,731 | A | 4/1975 | Jordan |
| 3,902,754 | A | 9/1975 | Braeuning |
| 4,348,053 | A | 9/1982 | Strassle |
| 4,542,887 | A | 9/1985 | Bethell et al. |
| 4,603,907 | A | 8/1986 | Witzke |

(Continued)

FOREIGN PATENT DOCUMENTS

| | | | |
|---|---|---|---|
| CN | 202908255 | U | 5/2013 |
| DE | 1464502 | A | 2/1977 |

*Primary Examiner* — Nahida Sultana

(74) *Attorney, Agent, or Firm* — St. Onge Steward Johnston & Reens, LLC

(57) ABSTRACT

A chair having a first frame portion with a backrest support and a rear leg portion at least part of the backrest support and the leg portion being formed from a single piece. A second frame portion has a seat support and a front leg portion extending in a direction transverse to the seat support, the seat support in a fixed position relative to the backrest support. The backrest support molded thereover in foam, the backrest support being substantially peripherally located around the foam of the backrest and the backrest being provided free from rigid supports extending across a middle portion of the backrest. The seat support molded thereover in foam, the seat support being substantially peripherally located around the foam of the seat and the seat being provided free from rigid supports extending across a middle portion of the seat.

11 Claims, 21 Drawing Sheets

(56) References Cited

U.S. PATENT DOCUMENTS

| | | | | |
|---|---|---|---|---|
| 4,702,522 | A | 10/1987 | Vail et al. | |
| 4,723,816 | A | 2/1988 | Seibert et al. | |
| 4,858,996 | A | 8/1989 | Blodee | |
| 5,316,375 | A | 5/1994 | Breen | |
| 5,393,126 | A | 2/1995 | Boulva | |
| 5,985,188 | A | 11/1999 | Jennings et al. | |
| 6,226,819 | B1 | 5/2001 | Ogawa et al. | |
| 6,286,902 | B1 | 9/2001 | Yoshimura | |
| 6,478,381 | B1 | 11/2002 | Cramb, III et al. | |
| 6,698,834 | B2 | 3/2004 | Olarte | |
| 7,690,732 | B2 | 4/2010 | Olarte | |
| 7,971,935 | B2 | 7/2011 | Saez et al. | |
| 8,573,704 | B2 | 11/2013 | Peters et al. | |
| 8,721,003 | B2 | 5/2014 | Waite et al. | |
| 9,420,890 | B2 | 8/2016 | Lee | |
| 9,630,539 | B2 | 4/2017 | Yokoyama et al. | |
| 2003/0085607 | A1 | 5/2003 | Jones et al. | |
| 2005/0173954 | A1 | 8/2005 | Weber et al. | |
| 2006/0080817 | A1 | 4/2006 | Klinker | |
| 2007/0210638 | A1 | 9/2007 | Adragna et al. | |
| 2009/0051207 | A1 | 2/2009 | Behrens et al. | |
| 2010/0176646 | A1 | 7/2010 | Rowland et al. | |
| 2012/0126596 | A1 | 5/2012 | Olarte | |
| 2012/0247313 | A1 | 10/2012 | Peters | |
| 2012/0248837 | A1 | 10/2012 | Peters | |
| 2015/0130236 | A1 | 5/2015 | Rogers | |
| 2015/0150380 | A1 | 6/2015 | Oh et al. | |
| 2015/0150381 | A1* | 6/2015 | Lee | A47C 7/18 297/452.18 |
| 2015/0158213 | A1* | 6/2015 | Mogi | B29C 39/10 264/46.9 |
| 2015/0296986 | A1 | 10/2015 | Rogers | |
| 2016/0331138 | A1 | 11/2016 | Olarte | |
| 2017/0079440 | A1 | 3/2017 | Todd | |
| 2017/0320415 | A1* | 11/2017 | Mueller | A47C 7/185 |
| 2019/0374035 | A1* | 12/2019 | Olarte | A47C 7/622 |

* cited by examiner

CHAIR FRAME WITH INJECTION MOLDED FOAM PADDING

FIELD OF THE INVENTION

The following relates to a chair and chair frame construction that using injection molded foam. More particularly, the following relates to a chair with a fixed seat whose seat back and seat are injection molded on the partially assembled frame.

BACKGROUND OF THE INVENTION

Moveable seating is used regularly for temporary venues, weddings, performance spaces, event halls, conference centers and other events requiring large numbers of chairs that can be moved or positioned differently, depending on the event for which they are being used. The comfort of these seats can vary widely from a traditional hard plastic seat with a folding frame to more comfortable padded chairs.

However, due to the large number of chairs typically kept on hand, costs are a significant concern. While plastic molding is relatively inexpensive, hard plastic seats may not provide desired comfort qualities.

Injection molded foam has been used to create a seat bottom which is designed to attach to separately to a chair and pivot, see e.g. U.S. Pat. No. 7,690,732 which is incorporated herein by reference. This describes a seat assembly that uses flexible supports and a foam cushion is molded around the flexible supports. However, this does not provide for a seat or back in which the foam is molded integrally with the support structure including chair legs.

SUMMARY OF THE INVENTION

Therefore, it is an object of the present invention to provide a chair and manufacturing method therefore that allows seat and back cushions to be integrally molded onto finished frames or frame pieces.

It is a further object of the present invention to provide a chair with a fixed seat which can be inexpensively manufactured and can integrate the upholstering process into the assembly of the chair frame.

These and other objects are achieved by providing a chair whose seat and back foam cushions are molded directly over the frame and in particular aspects, the frame is made in two pieces, the foam is molded to the two pieces and those two pieces are press fit together.

In one aspect a chair is provided including a first frame portion having a backrest support and a rear leg portion at least part of the backrest support and the leg portion being formed from a single piece. A second frame portion has a seat support and a front leg portion, the front leg portion extends in a direction transverse to said seat support, the seat support in a fixed position relative to the backrest support. The backrest support is molded thereover in foam to define a backrest, the backrest support being substantially peripherally located around the foam of the backrest and the backrest being provided free from rigid supports secured to the backrest support and extending across a middle portion of the backrest. The seat support is molded thereover in foam to define a seat, the seat support being substantially peripherally located around the foam of the seat and the seat being provided free from rigid supports secured to the seat support and extending across a middle portion of the seat.

In certain aspects, the second frame portion is formed at least in part by welding together two pieces which make up the front leg portion and seat support. In certain aspects the front leg portion and the seat support are part of a single piece. In other aspects, a receiver is located on one of the first or second frame portions and a protrusion located the other one of the first or second frame portions, the protrusion press fit into the receiver to secure the first and second frame portions together. In other aspects, the receiver is part of the seat support. In still other aspects, the front leg portion is permanently attached to the seat support at an attachment point and the attachment point is located at least partially within the foam of the seat support. In other aspects, the first frame portion is made from a bent bar.

In other aspects, a chair is provided including a first frame piece having rear legs and a seat back connected thereto, the seat back having foam molded thereover; and a second frame piece having front legs and supports transverse to the front legs, the supports at least in part supporting a seat bottom comprised of foam molded thereover and each support being permanently attached to one of the front legs. The seat back and seat bottom are in a fixed relationship with respect to each other and the first and second frame pieces are secured together by press fitting a protrusion of one of the first or second frame pieces into a receiver of the other one of the first or second frame pieces.

In certain aspects each support is attached at an attachment point to one of the front legs, the attachment point being surrounded by the foam. In other aspects, the receiver is located on the first frame portion and a protrusion located on the second frame portion. In other aspects the seat support is a hollow member and the receiver is an end of the hollow member. In other aspects, the first frame piece includes a horizontal bar and the second frame piece includes a slotted horizontal bar having a slot. A cover member is configured to fit over at least part of the second frame piece, the cover member an opening along a side with two elongated loops, the elongated loops configured to fit into the slot. The first and second frame pieces are securable together such that the horizontal bar faces the slot with at least a portion of the cover member is held between a first face of the horizontal bar and a second face of the slotted horizontal bar to secure the cover member to the second frame. In certain cases, the protrusion is welded to the first frame portion. In other aspects, two elongated members are configured such that each one of the two elongated members fits into one of the two loops, wherein the two elongated members when inside the respective two loops are positioned at least partially within the slot and spacing between the first and second faces inhibits removal of the upholstery cover.

In other aspects, a chair is provided including a first frame portion comprising a backrest support and a rear leg portion; and a second frame portion comprising a seat support and a front leg portion in a fixed position relative to said first frame portion, the first and second frame portions secured together via press-fitting. The backrest support is molded thereover in foam to define a backrest, the backrest support being substantially peripherally located around the foam of the backrest to define a periphery of the backrest support and the backrest being provided free from rigid supports secured to the backrest support and extending across an interior portion of the periphery of the backrest support. The seat support is molded thereover in foam to define a seat, the seat support being substantially peripherally located around the foam of the seat to define a periphery of the seat support and the seat being provided free from rigid supports secured to the seat support and extending across the periphery of the seat support.

In certain aspects, a receiver is located on one of the first or second frame portions and a protrusion located the other one of the first or second frame portions. The protrusion is press fit into the receiver to secure the first and second frame portions together. In other aspects, the receiver is part of the seat support.

In other aspects a method of manufacturing a chair comprises one or more of the steps of: providing a first frame having rear legs and a back support portion; providing a second frame having front legs and a seat support portion; inserting the first frame into a first mold portion such that the rear legs extend out of the first mold portion and the back support portion of the frame is contained within the mold; inserting the second frame into a second mold portion such that the front legs extend out of the second mold portion and the seat support portion of the frame is contained within the mold; introducing foam into the first and second mold portions; removing the first and second frames from the respective molds and securing the first and second frames together.

In certain aspects, the first mold portion has a parting line separating two portions of the first mold portion and when closed the rear legs extend out an opening defined by a channel in each of the two portions. In certain aspects, the second mold portion has a parting line separating two portions of the second mold portion and when closed the front legs extend out holes in one of the two portions. In certain aspects one of the first or second mold portions includes movable protrusions which protrude into the cavity of the one of the first or second mold portions and are moveable and the method further includes the step of: moving the moveable protrusions into engagement with a receiver in one of the first or second frames to inhibit foam from entering the receiver.

In other aspects a mold is provided for manufacturing a chair having a frame with one or more legs. First and second mold portions are configured to close to contain portions of the frame. A hole in one of the first or second mold portions receives foam therein. One or more openings in the each of the first and second mold portions is configured to allow two of the one or more legs to extend through the one or more openings and out the mold such that the mold seals around the two of the one or more legs.

In certain aspects the one or more openings of the first mold portion are defined by two pairs of channels, one of the channels of each of the two pairs of channels positioned on the first mold portion and one of the channels of each of the two pairs of channels positioned on the second mold portion such that when the first and second mold portions are closed, the channels align to form two openings each configured to allow one of the one or more legs to extend there through. In certain aspects the one or more openings of the second mold portion are defined by two holes spaced apart to allow two of the one or more legs to extend through the holes out the mold such that the mold seals around the two of the one or more legs, the holes located in a mold surface which defines a bottom portion of a seat of the chair.

In other aspects, an upholstery system for a chair comprises first and second frame pieces. The first frame piece has a first set of legs and a first support portion and a horizontal bar. The second frame piece has a second set of legs, a second support portion and a slotted horizontal bar having a slot. A cover member fits over at least part of the second frame piece, the cover member an opening along a side with two elongated loops, the elongated loops configured to fit into the slot. The first and second frame pieces are securable together such that the horizontal bar faces the slot with at least a portion of the cover member held between a first face of the horizontal bar and a second face of the slotted horizontal bar to secure the cover member to the second frame.

In certain aspects two elongated members are configured such that each one of the two elongated members fits into one of the two loops, wherein the two elongated members when inside the respective two loops are positioned at least partially within the slot and spacing between the first and second faces is less than a thickness of at least one of the two elongated members.

Other objects are achieved by providing a chair having first and second frame pieces, the first frame piece has a first set of legs and a first support portion and a first horizontal bar. The second frame piece has a second set of legs, a second support portion and a second horizontal bar. A cover member fits over at least part of the second frame piece. The cover member has an opening along a side with two tabs, the cover member further includes two holes at an end opposite the opening, each of the two holes is configured to receive a leg of the second set of legs. The first and second frame pieces are securable together such that the first horizontal bar faces the second horizontal bar with at least a portion of the cover member held between a first face of the first horizontal bar and a second face of the second horizontal bar.

Other objects of the invention and its particular features and advantages will become more apparent from consideration of the following drawings and accompanying detailed description.

DETAILED DESCRIPTION OF THE INVENTION

Figure 1:
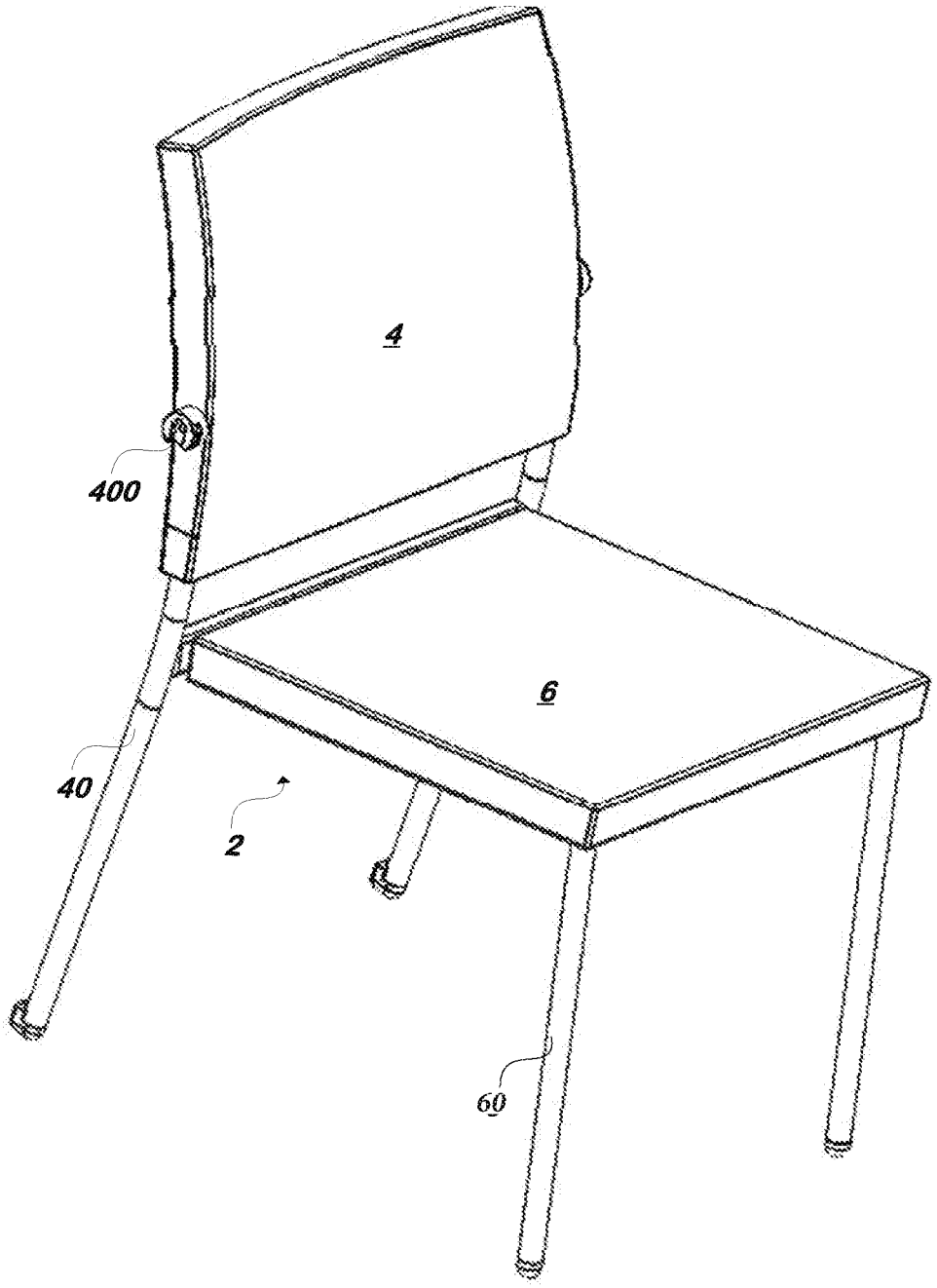
FIG. 1 is a perspective view of a chair according to the present invention.

Referring now to the drawings, wherein like reference numerals designate corresponding structure throughout the views. The following examples are presented to further illustrate and explain the present invention and should not be taken as limiting in any regard.

Figure 2:
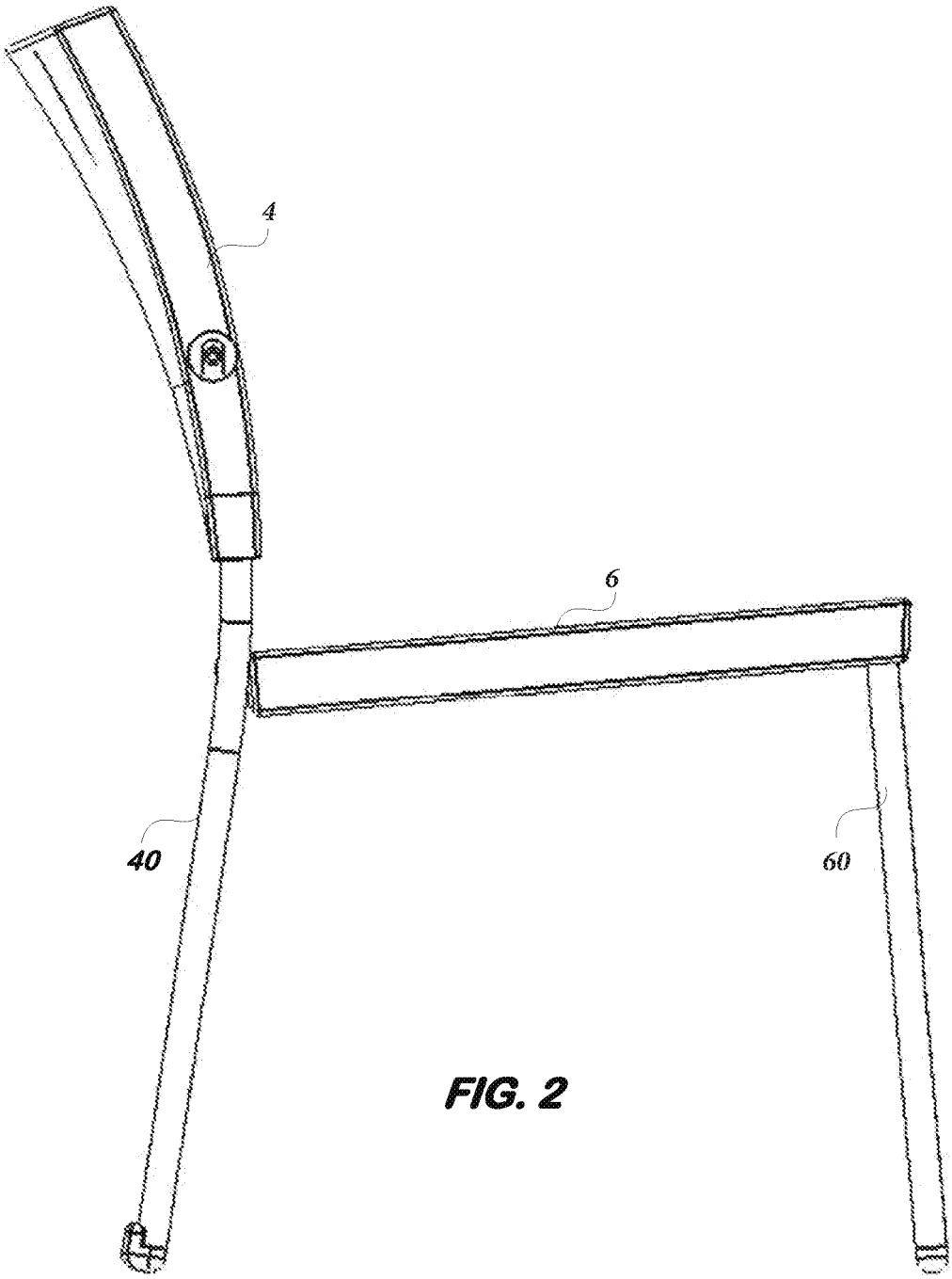
FIG. 2 is a side view of the chair of FIG. 1
Figure 3A:
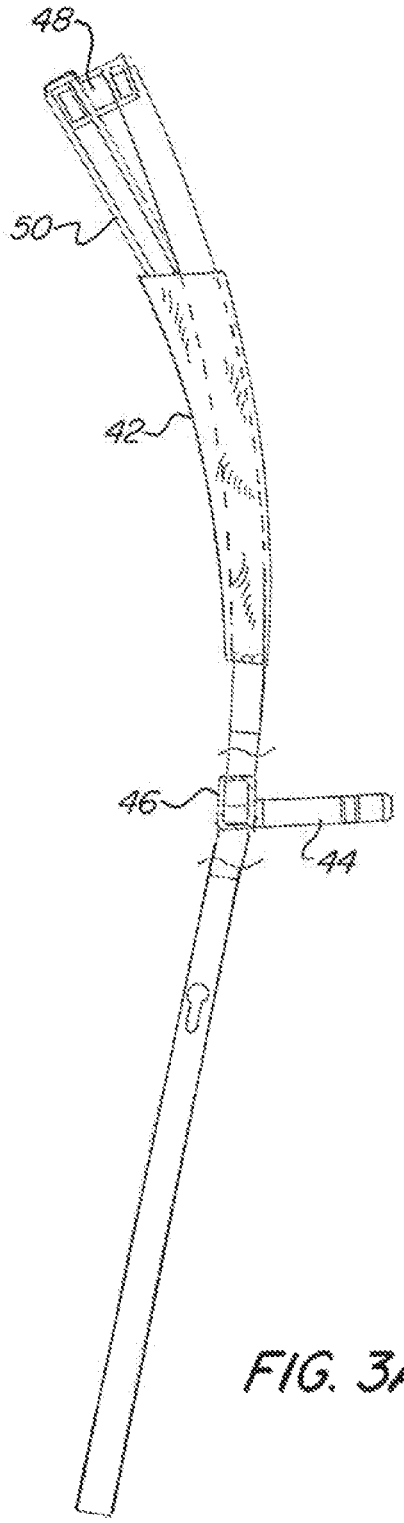
FIG. 3A is a side view of part of the chair of FIG. 1 during manufacturing.
Figure 3B:
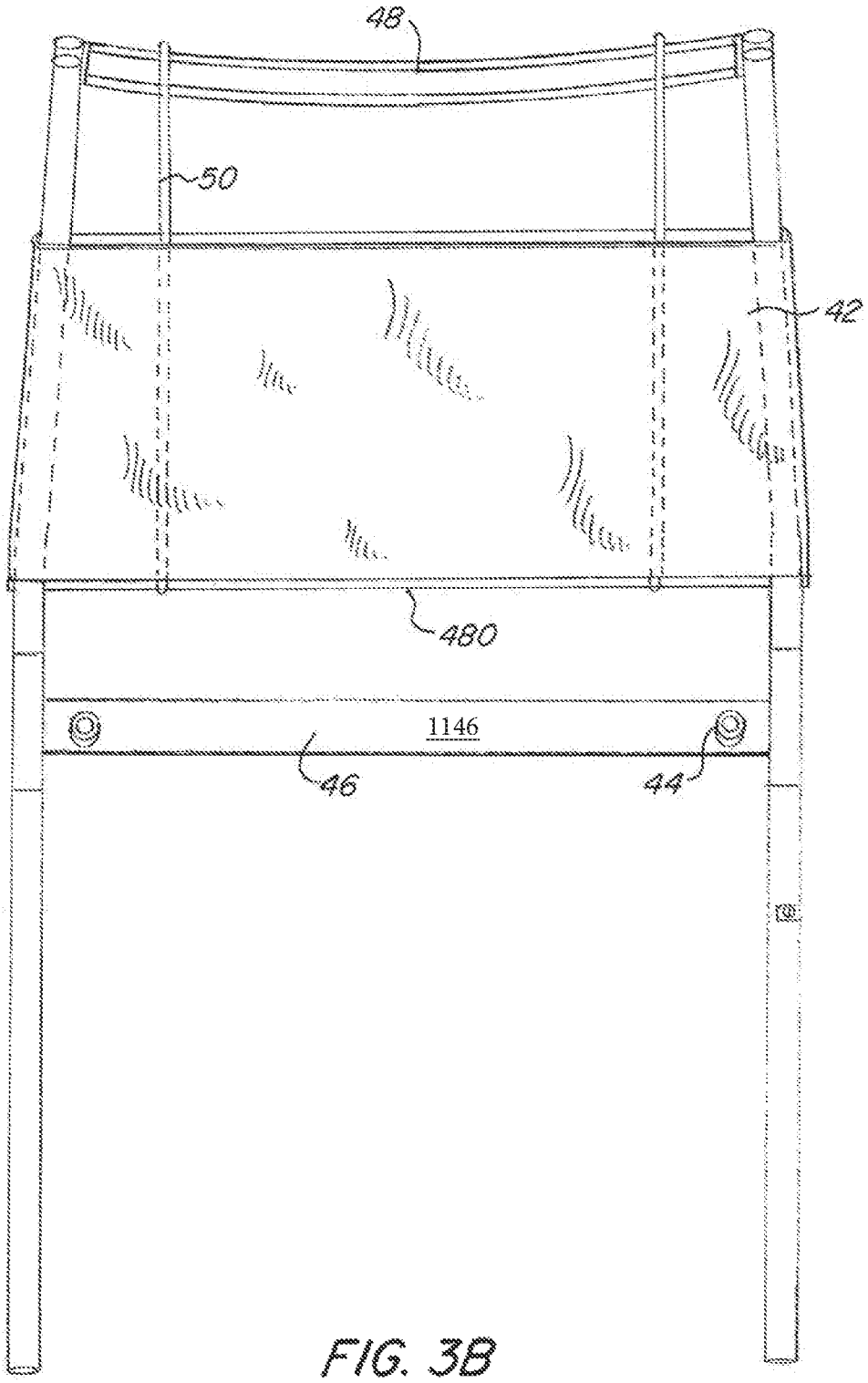
FIG. 3B is a front view of part of the chair of FIG. 1 during manufacturing.
Figure 4:
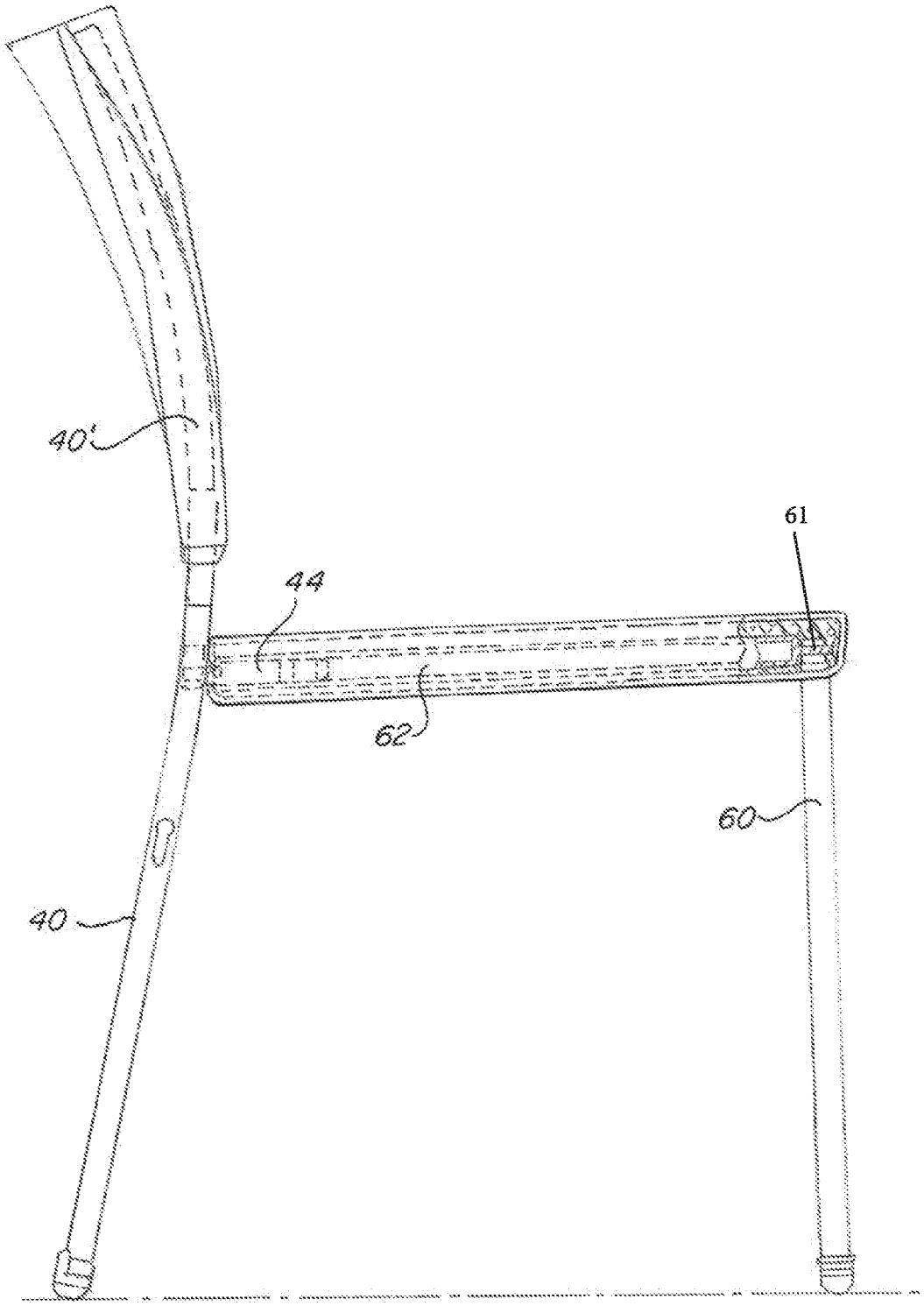
FIG. 4 is a side view of the chair of FIG. 1 showing certain internal details in broken lines/cutaway/section.
Figure 5:
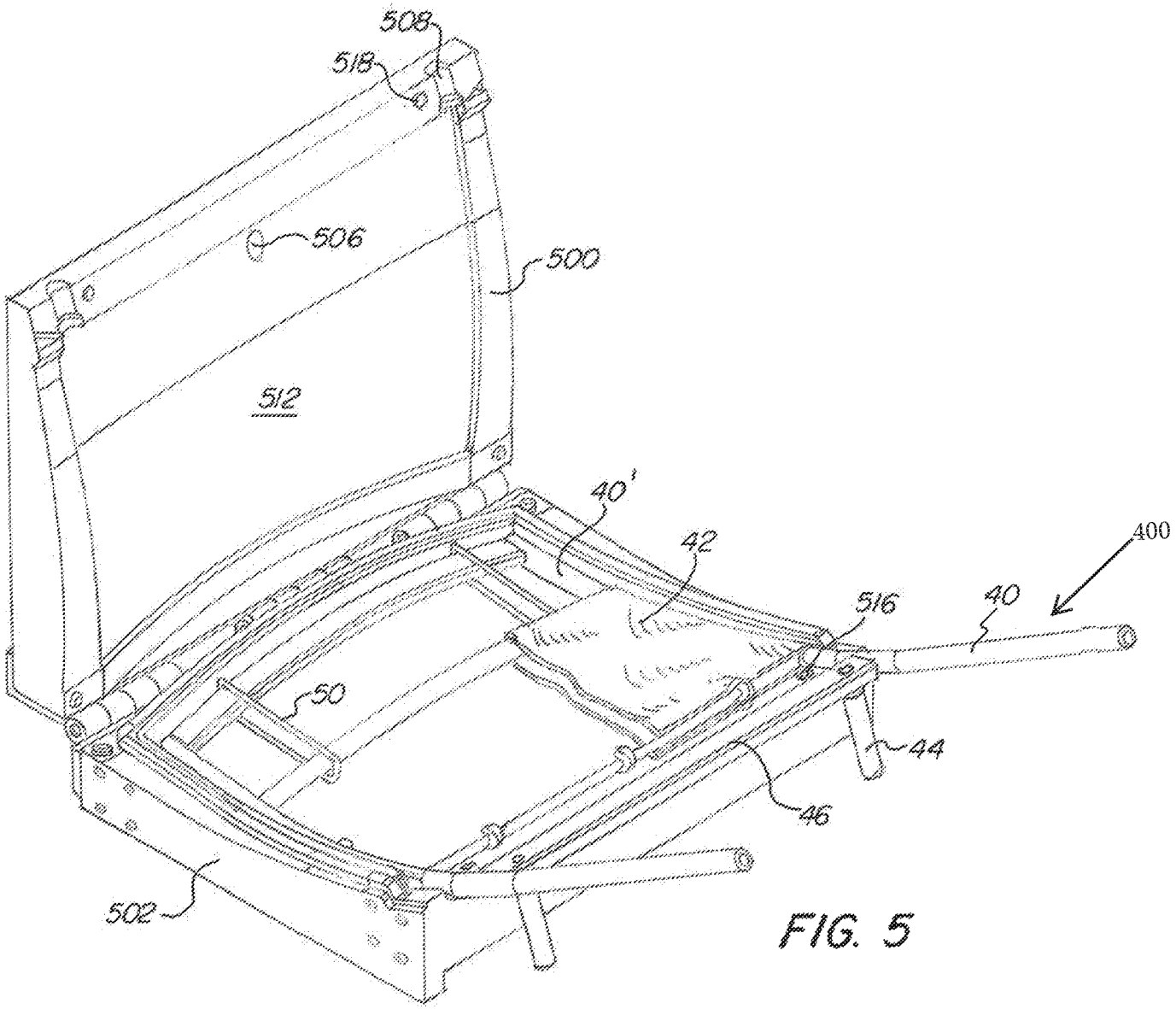
FIG. 5 is a perspective view of one mold used for making the chair of FIG. 1
Figure 6:
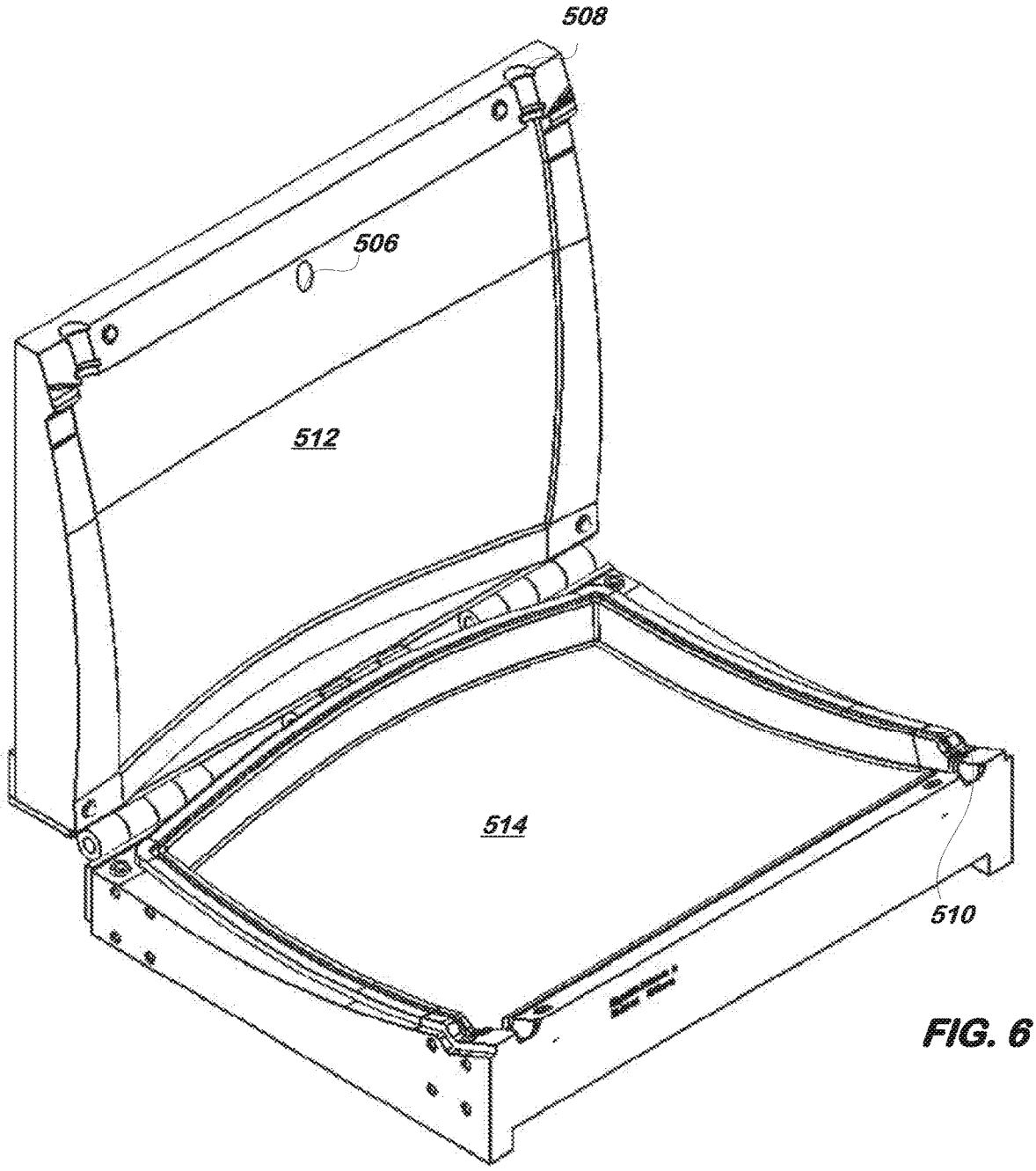
FIG. 6 is a perspective view of the mold of FIG. 5 without the chair frame piece therein.
Figure 7:
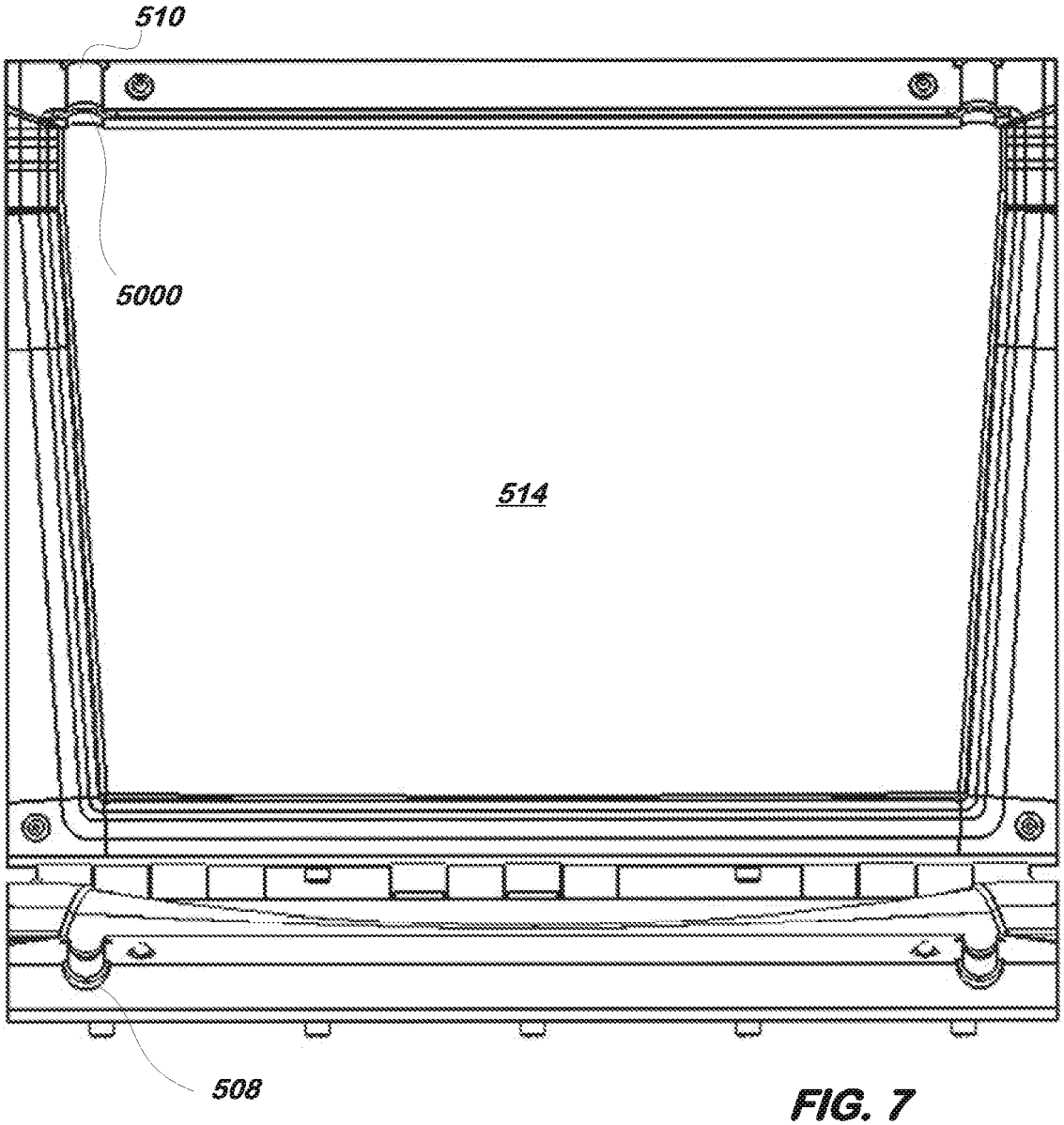
FIG. 7 is a top view of the mold of FIG. 5.
Figure 8:
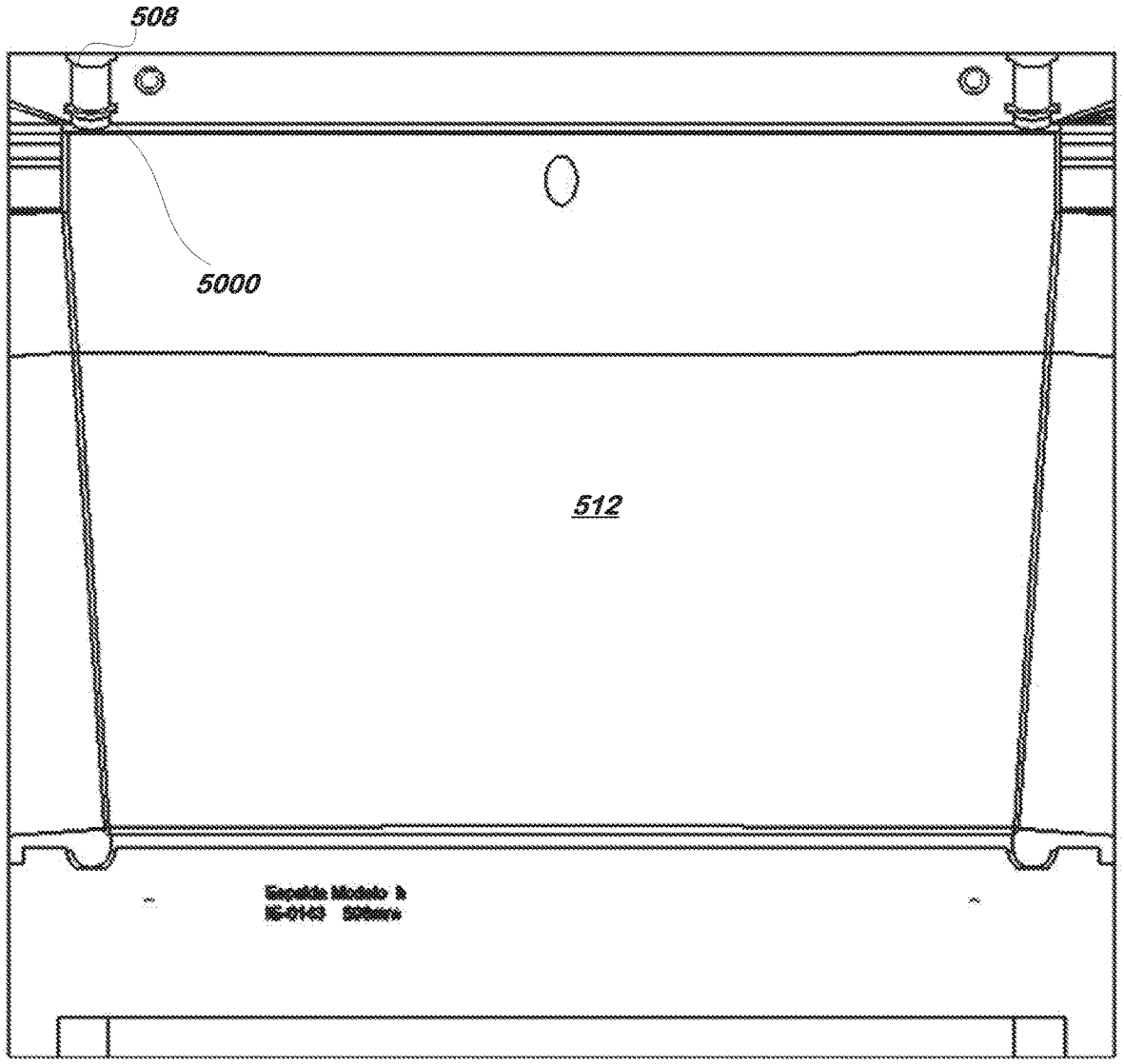
FIG. 8 is a front view of the mold of FIG. 5.

As shown in FIG. 1-2, a chair 2 is provided with a bottom/seat 6 and a back 4. Legs 60 and 40 are provided to support the chair. The seat 6 and back 4 utilize an internal flexible support structure, an example of which is shown in FIG. 3A-B for the back support structure 42. As shown herein, the foam padding is injection molded around the flexible support structure. The rear legs 40 are spaced apart by support bar 46 (which may be considered a horizontal bar) which includes two protrusions 44 which extend approximately perpendicular to the support bar 46. The legs 40 as shown are bent rod or bar and include the bottom straight leg and the upper section by the back which is curved for an ergonomic fit. Top cross bar 48 holds the legs 40 spaced apart at the top end and also secure the straps 50 which hold the webbing/flexible support 42 in place during molding. The protrusions 44 insert into a generally horizontal part of the frame for the seat and front legs as shown in FIG. 4, particularly horizontal bar/tube 62 which is welded/connected to front leg 60 at attachment point 61. FIG. 4 shows this horizontal bar/tube 62 as a hollow support. As can be seen, this attachment point 61 is molded therearound in foam such that it is fully or at least partially surrounded in foam.

FIGS. 5-8 show the mold for the rear legs/back of the chair. As can be seen, the rear frame 400 is placed in the mold. The straight part of the leg 40 and the protrusions 44 are located on the outside of the mold and the leg extends through channels 508/510 which when closed forms a circular/cylindrical opening that seals to the leg. The upper part of the rear frame 400 rests inside the mold cavity and the mold cavity is curved to fit the curved section 40' of the frame 400. The flexible support structure 50/42 is provided within what will become the molded seat back. The webbing 42 is partially shown but it is understood that such webbing 42 would extend across the frame piece. The clip 50 is used to hold the webbing 42 in place when foam is introduced into the mold. The mold bottom 502 is hinged to the mold top 500 which closes to define the cavity. Registers 518/516 ensure proper alignment and hole 506 receives foam there through. Typically, a release agent will be applied to the inside of the mold, the frame 400 will be placed such that the leg 40 extends out of the mold and the top of the mold will be securely closed. Then, the foam is introduced through hole 506. As can be seen, the surface 514 and 512 of the mold is curved to provide the shape of the seat back. In certain aspects, the channels 510/508 include an o-ring or semi flexible sealing portion 5000 to seal against the rear leg 40 of the chair to inhibit foam from expanding out the channels when the mold is closed. In certain embodiments, close tolerancing is used to provide a seal which inhibits foam from exiting the mold. In particular aspects, the frame parts which are molded are finished prior to molding with their finish paint, powder coat or other coating. In addition, the protrusion 44 and bar 46 are located outside of the mold cavity when the mold is closed. This enables press fit assembly of the frame pieces after the foam is molded thereon.

Figure 9:
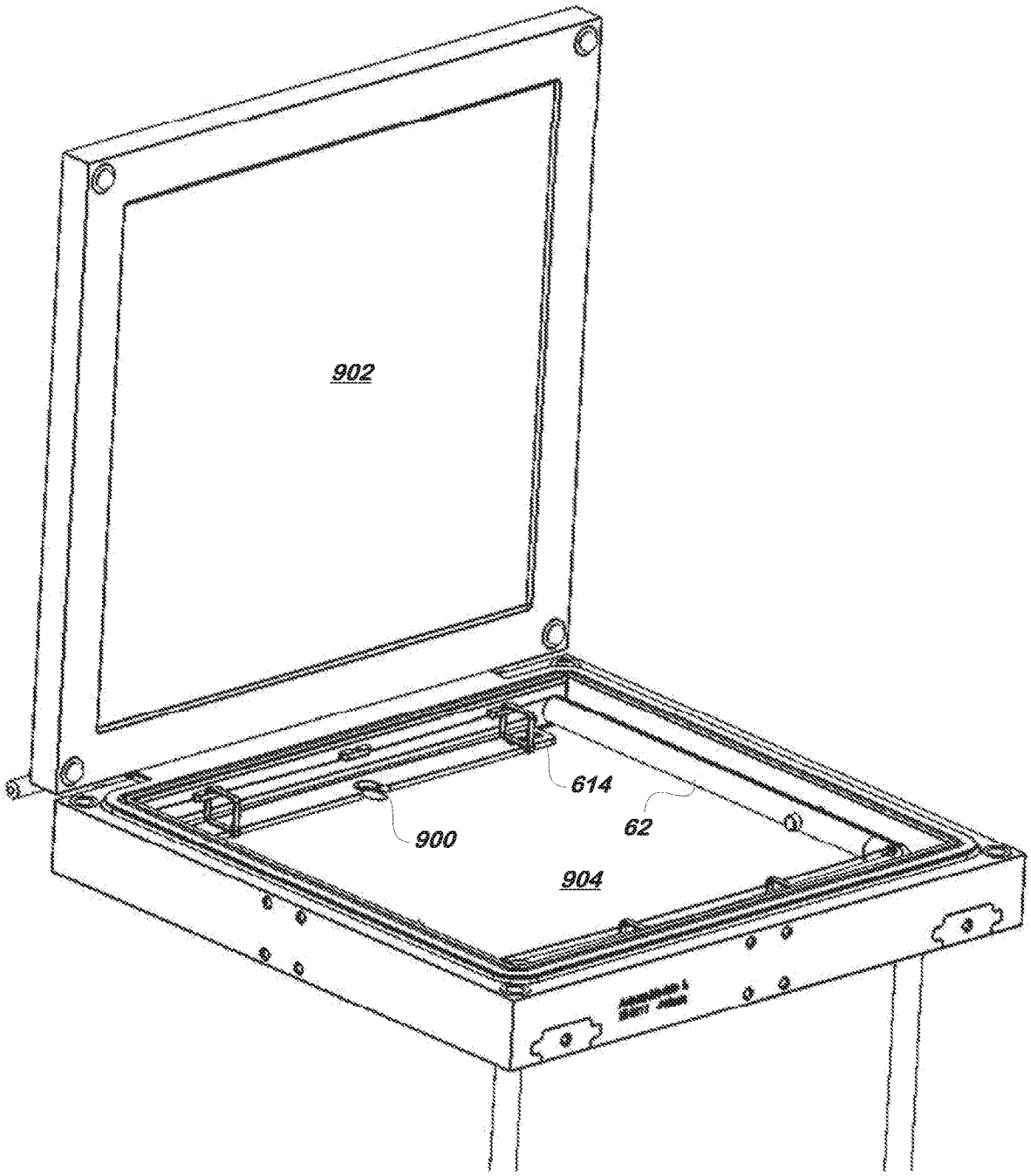
FIG. 9 is a perspective view of another mold for making the chair of FIG. 1 with a chair frame piece therein.
Figure 10:
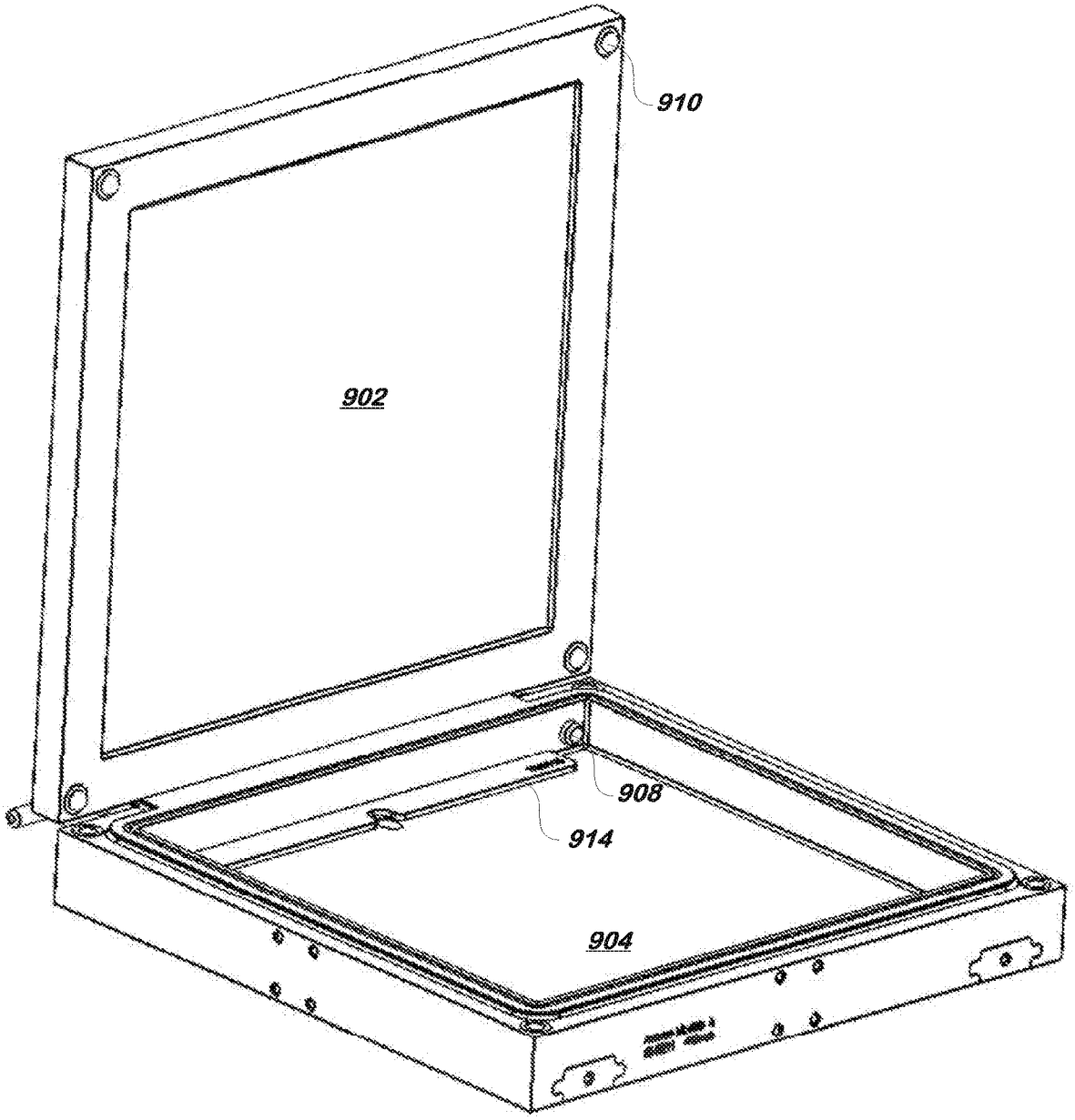
FIG. 10 is a perspective view of the mold of FIG. 9 without the chair frame piece therein.
Figure 11:
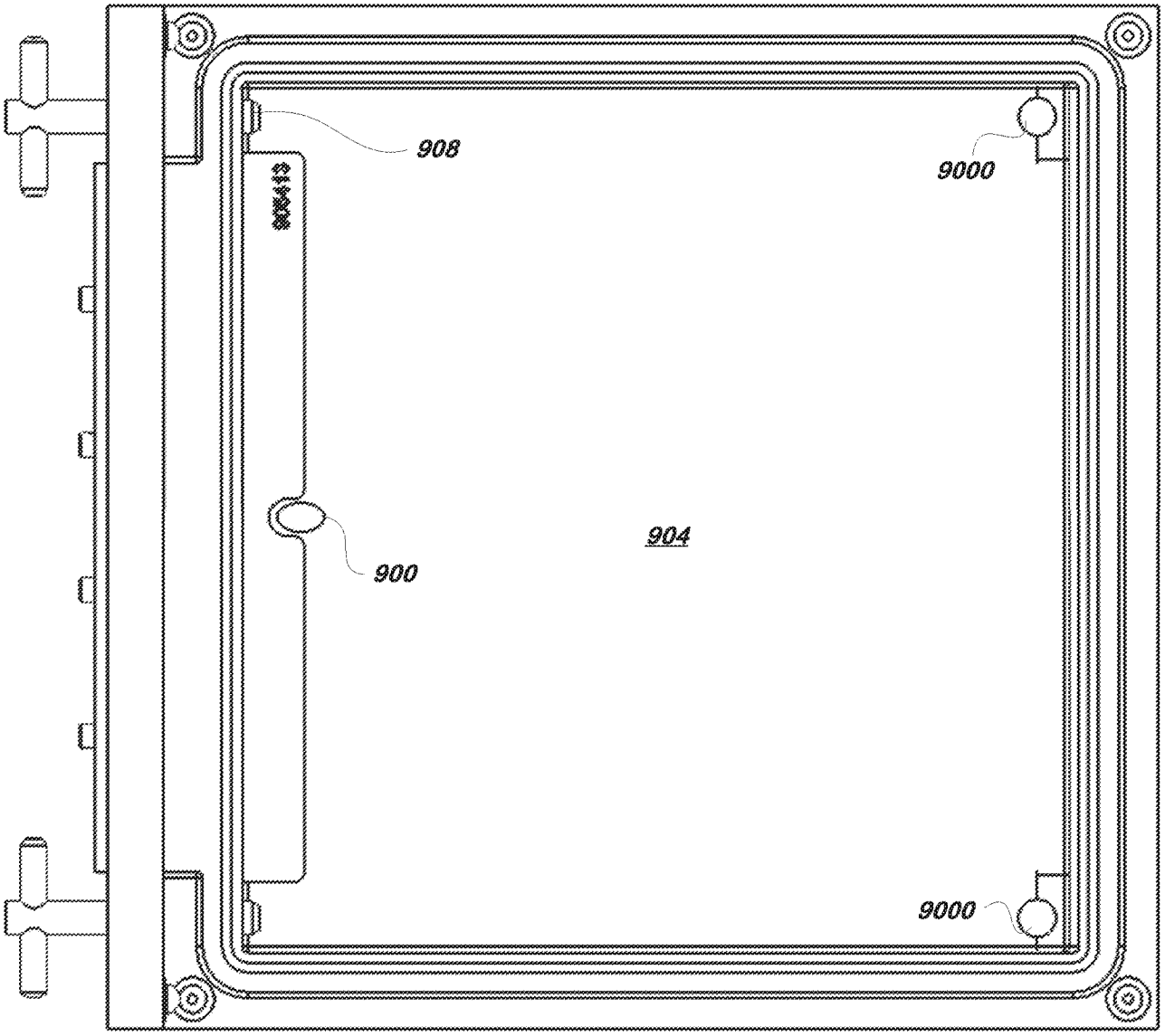
FIG. 11 is a top view of the mold of FIG. 9.

FIG. 9 shows the seat bottom mold with frame 6000 therein. As can be seen, the generally horizontal support 62 is positioned in the mold cavity and the generally vertical leg 60 extends out the bottom of the mold. Surfaces 902 and 904 of the mold define the upper and lower surface shapes for the foam. Foam is injected into hole 900 and clips 614 assist in holding the flexible support/webbing (not shown) in place during molding. FIG. 10 shows the mold with the frame 6000 removed. Registers 912/910 interact to ensure proper alignment of the mold halves when closed. Protrusion 908 is moveable along its axis by manipulation (e.g. rotation) of handle 916. The protrusion 908 is designed to fit into the end opening of the generally horizontal support 62 to inhibit foam from entering/filling that opening as the protrusions 44 of the rear seat frame half will insert into the horizontal support 62 in a press fit or other securing manner during final assembly. Plate/support 914 holds the rear end of the frame 6000 at the appropriate height to ensure correct molding of the foam. From the top view of the mold in FIG. 11, the holes 9000 can be seen. The legs 60 of the seat bottom frame half 6000 insert through these holes and then the mold is closed. As with the other mold half for the seat back/frame, the mold may be sprayed first with a release agent and handle 916 is then manipulated to insert protrusion 908 into the end of the generally horizontal frame piece 62. The mold is then securely closed and foam inserted via hole 900.

Figure 12A:
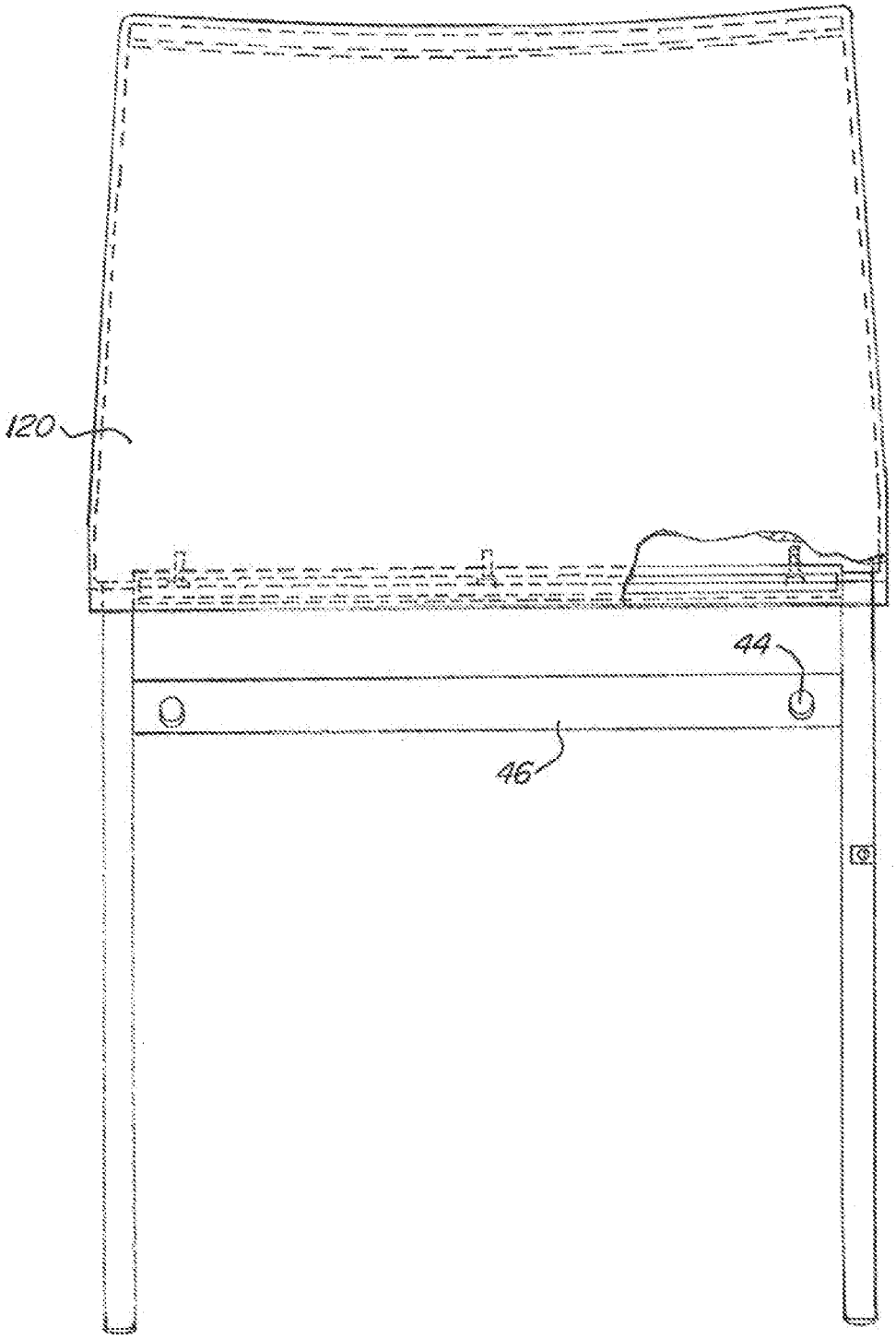
FIG. 12A is a front view of one frame piece of the chair of FIG. 1.
Figure 12B:
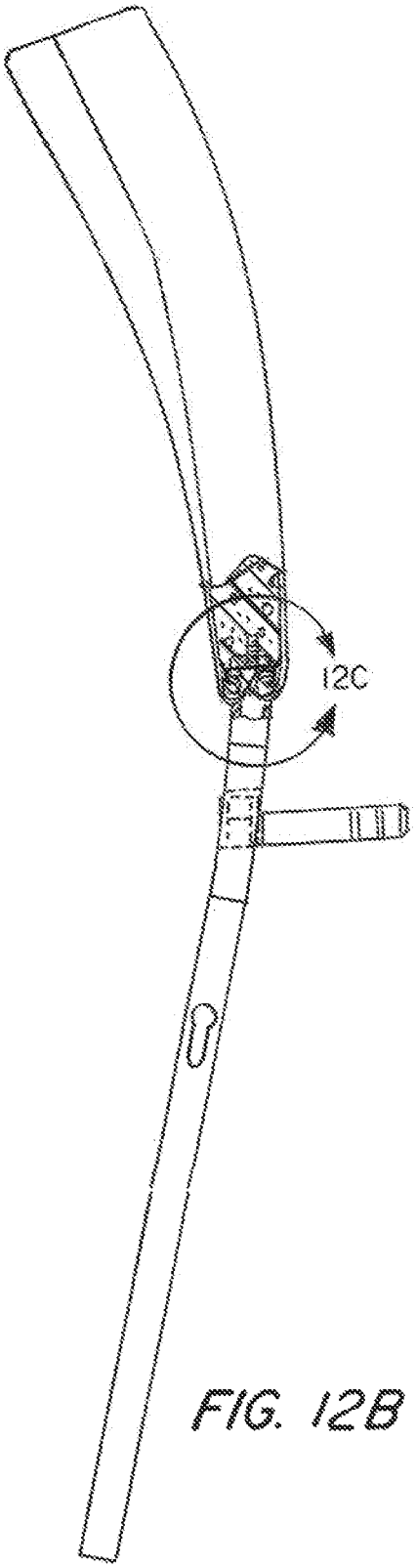
FIG. 12B is a side partial section view of a frame piece of the chair of FIG. 1.
Figure 12C:
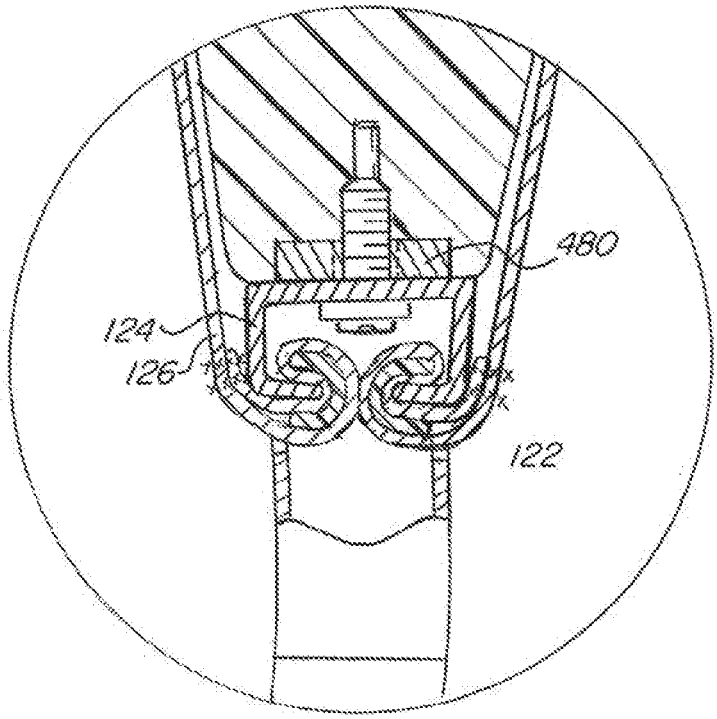
FIG. 12C is a detail view of FIG. 12B.

Referring to FIG. 12A-C, the back upholstery 120 securing system is shown. A "C" channel 124 is secured to the bottom of the back and the cover 120 is placed there around. C clips 122 insert into loops 126 to hold the upholstery/cover 120 to the seat back.

Figure 13B:
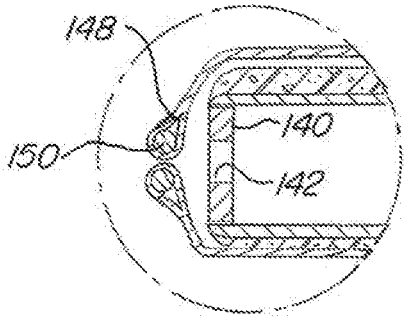
FIGS. 13A-C show the assembly process of the two frame pieces of the chair of FIG. 1.
Figure 13C:
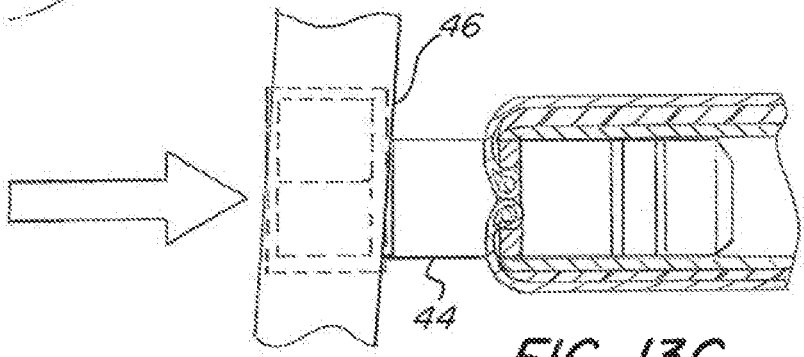
Figure 13A:
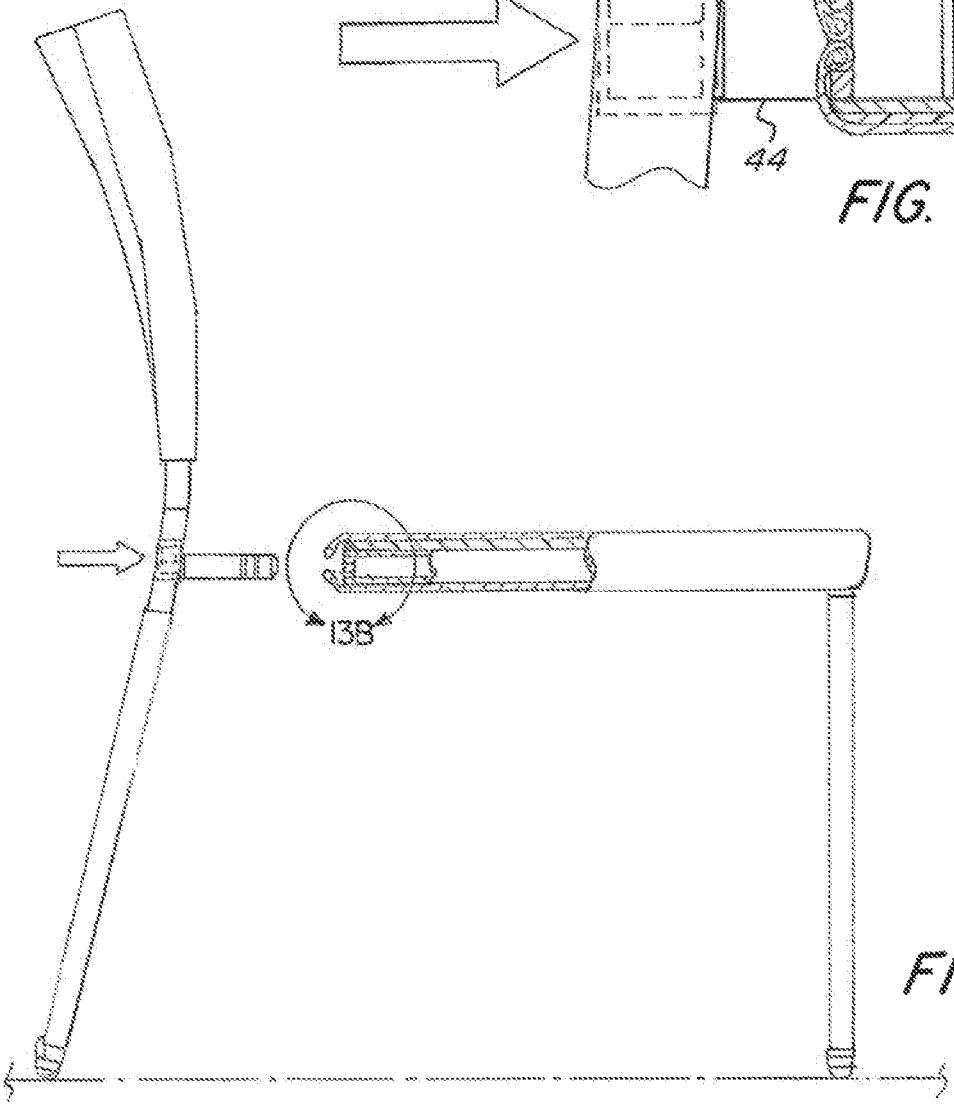
Figure 14:
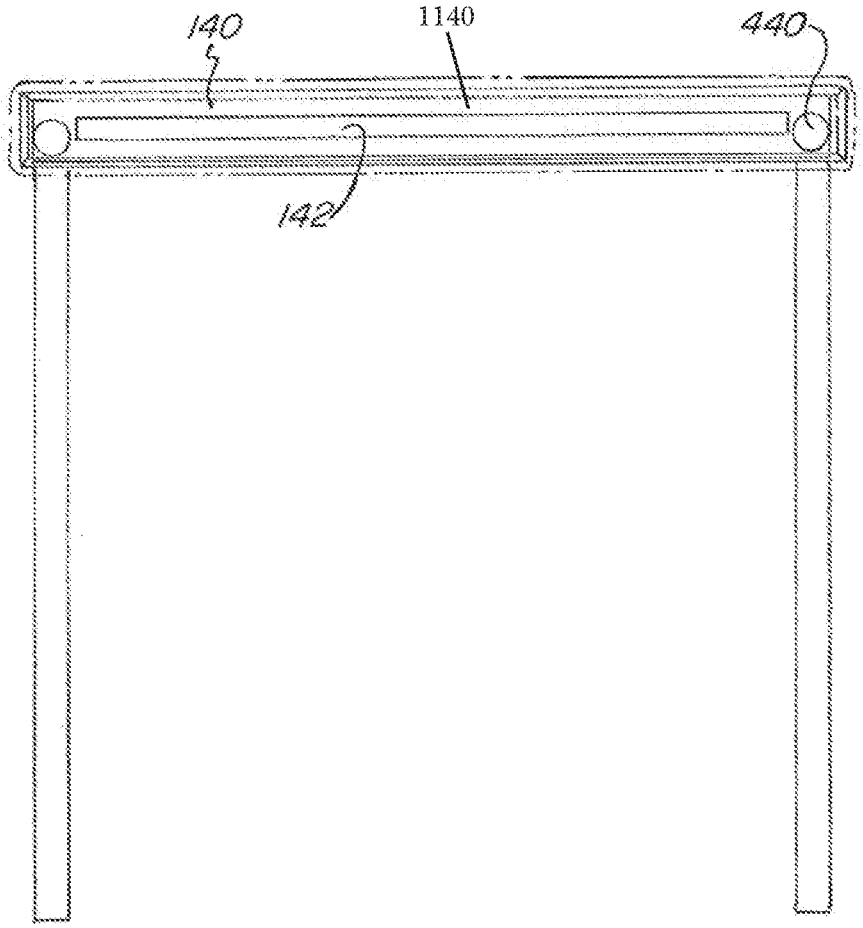
FIG. 14 shows a rear view of one of the frame pieces of the chair of FIG. 1.
Figure 15:
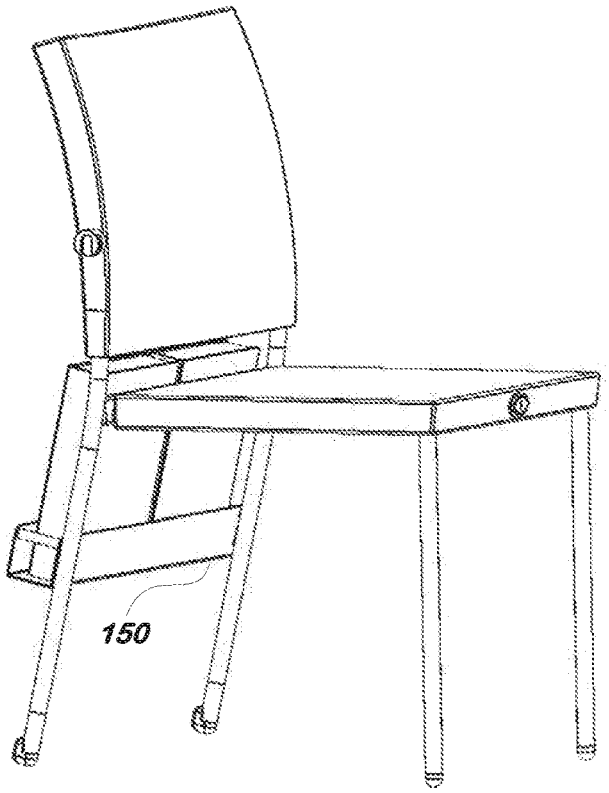
FIG. 15 shows a perspective view of the chair of FIG. 1 with a rear mounted book holding accessory mounted thereon.
Figure 16:
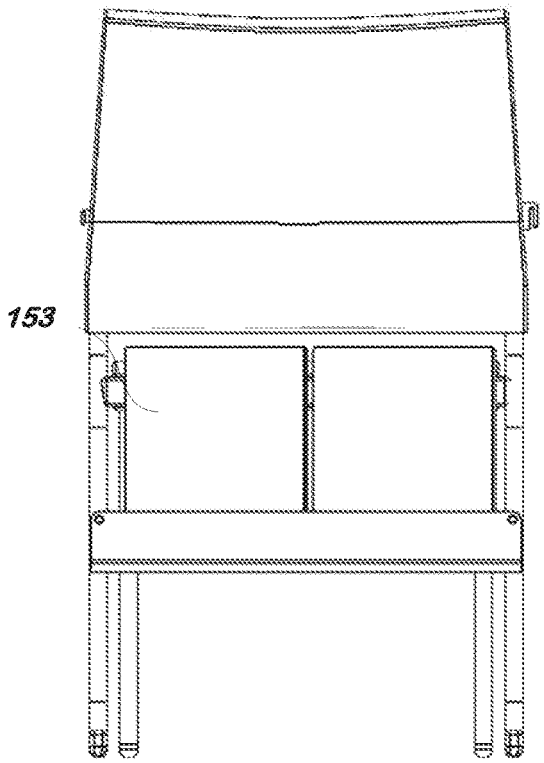
FIG. 16 shows a rear view of the chair of FIG. 15.
Figure 17:
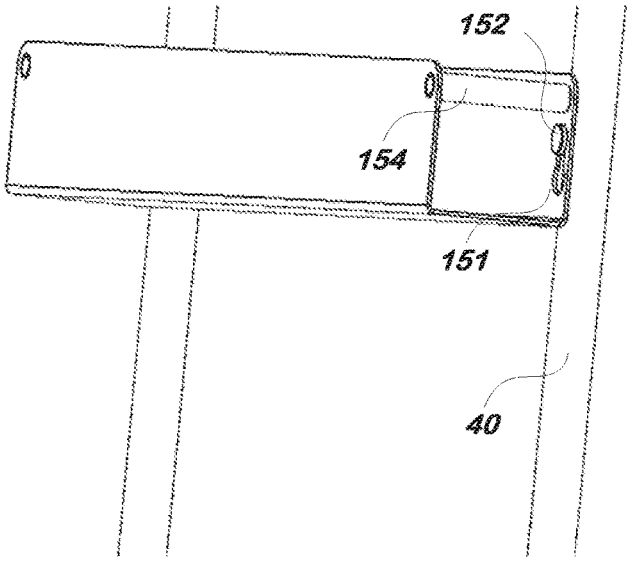
FIG. 17 shows a detail rear perspective view of the chair of FIG. 15.
Figure 18:
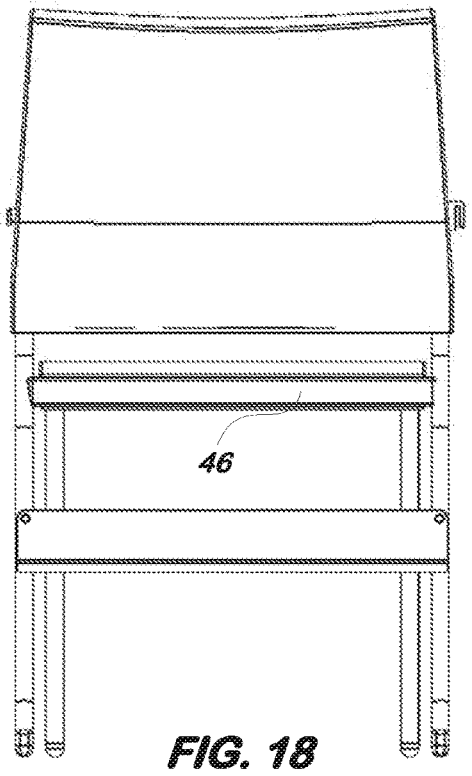
FIG. 18 shows a rear view of the chair of FIG. 15 with the books removed.

FIG. 13A-C shows the assembly process for the chair which also doubles as the process by which the seat bottom upholstery is secured. The upholstery cover includes tabs having loops 148 thereon and elongated members 150 at one end. The seat frame piece includes a rear bar 140 (which may be considered a horizontal bar) with a slot 142 therein. These loops 148 are fitted into the slot 142 and then the protrusions 44 are inserted into the supports 62 via press fitting. As the protrusions 44 are mounted to bar 46, as the protrusions are pressed into the supports 62, a face 1146 of the bar 46 presses against the upholstery cover at the loops 148. Then the loops and part of the upholstery cover becomes trapped between bar 46 and face 1140 of bar 140 and given that the elongated members 150 are also trapped in the loops 148, the loops cannot be pulled out of the slot 142 as the distance when assembled between the bar 46 and bar 140 is smaller than the thickness of the loops with the supports therein, more particularly, smaller than the thickness of the elongated members 150. In certain embodiments, the bar 46 contacts the upholstery cover on its outer surface and the bar 140 contacts the inner surface of the upholstery cover to effectively sandwich the upholstery cover between the bars 46/140. Instead of loops 148, hook and loop fastening could be used to secure the cover to the seat bottom.

It is also understood that the cover is placed over the frame 6000 and includes holes for the legs 60 to extend out of.

Referring to FIGS. 15-18, a book holder 150 is configure to attach to the rear legs 40 of the chair. This can be particularly useful in churches and places of worship in that large books 153 can be held on the back of the chair for the row behind that chair. The holder 150 secures to the leg with narrowing slot 151 and support 152 which is shaped like a nail head which is trapped in the narrowed portion of the slot 151 to inhibit movement downwards, side to side and backwards. To remove the holder 150, the holder is pressed up so that the nail head 152 can be aligned with the larger portion of the slot 151 and moved backwards. The holder 150 is generally U shaped or three sides of a square channel. Bar 154 provides additional rigidity to the U shaped cross section.

Figure 19:
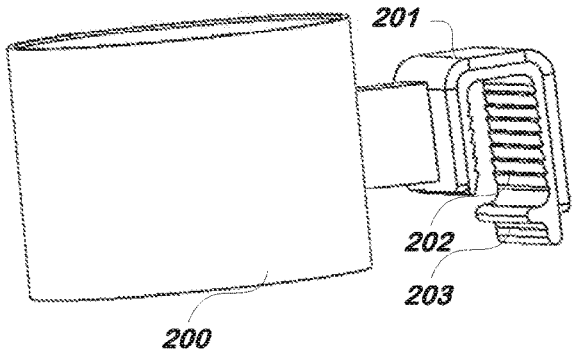
FIG. 19 shows a cup holder for installation on the chair of FIG. 1
Figure 20:
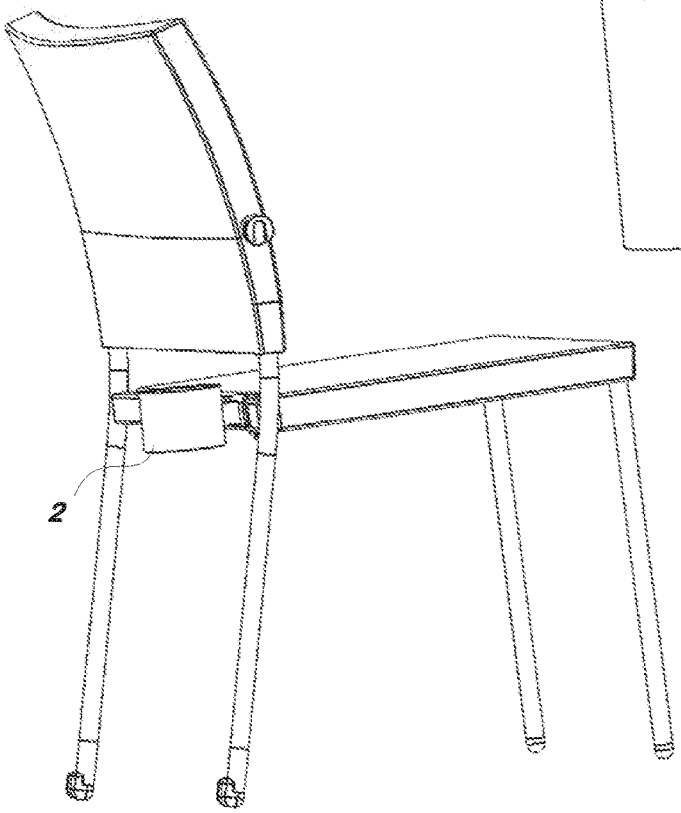
FIG. 20 shows the cup holder of FIG. 19 mounted to the chair of FIG. 1
Figure 21:
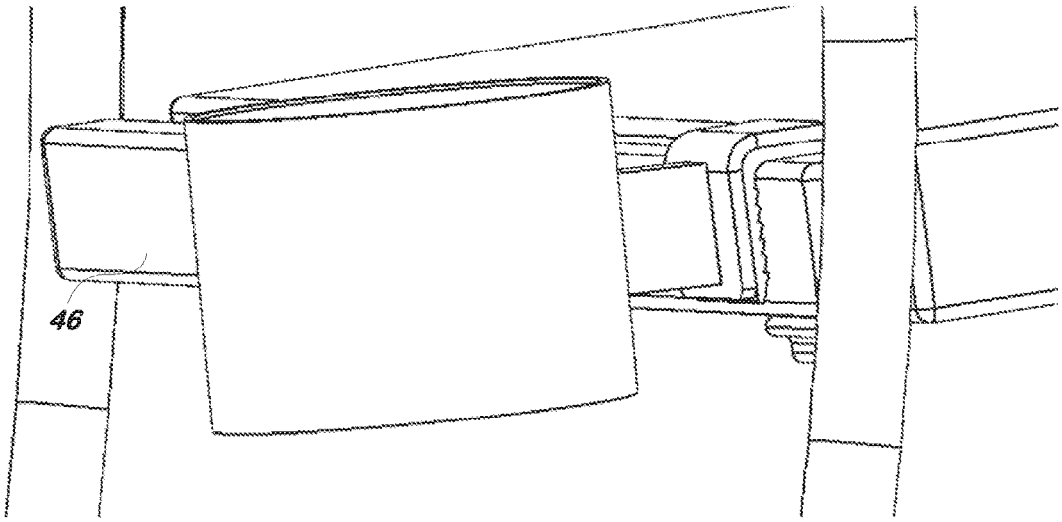
FIG. 21 shows a detail view of FIG. 20.

An additional option of a cup holder is shown in FIGS. 19-21. The cup holder 200 has a connector with a U shaped 201 support which secures to bar 46 on the chair. The support 201 can include elastomeric/rubber/plastic molded teeth 202 and clip 203 to more securely hold the cup holder in place. In preferred embodiments, the cup holder 200 primarily metallic material. The upholstery cover in this instance may be secured to the chair bottom with a hook and loop closure system from two flaps which are secured together behind the bar 46. Such flaps would replace the loops 148 and overlap in the hook and loop securing embodiment.

Figure 22:
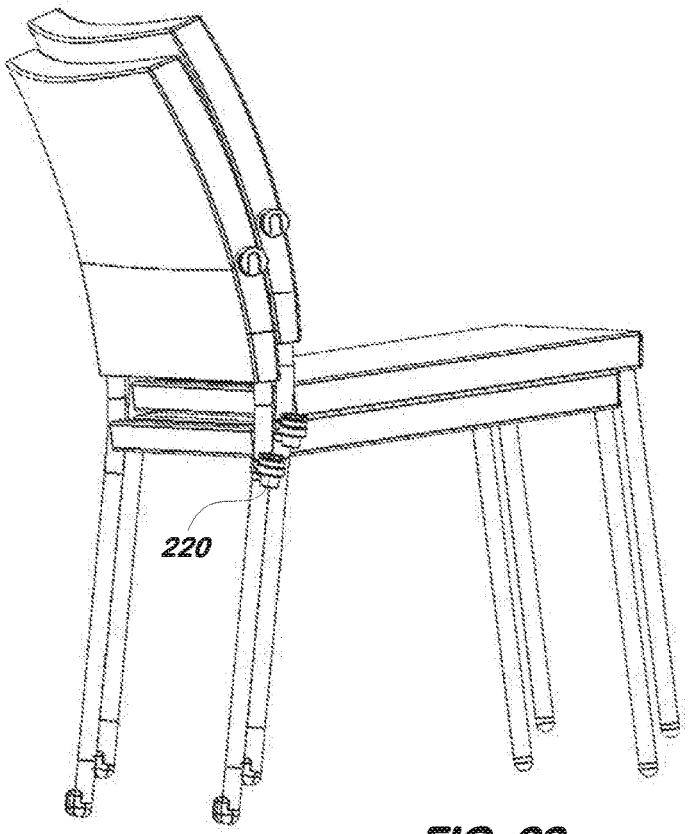
FIG. 22 shows the chair of FIG. 1 stacked with an alternative cup holder.
Figure 23:
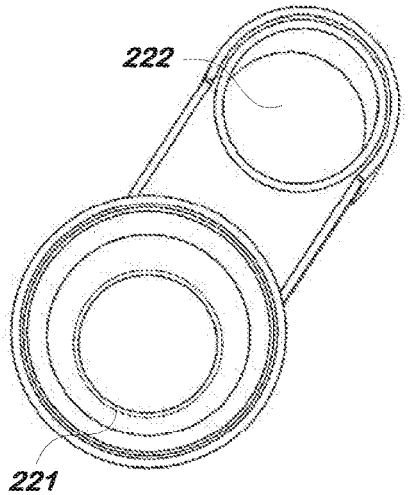
FIG. 23 shows a top view of the cup holder.
Figure 24:
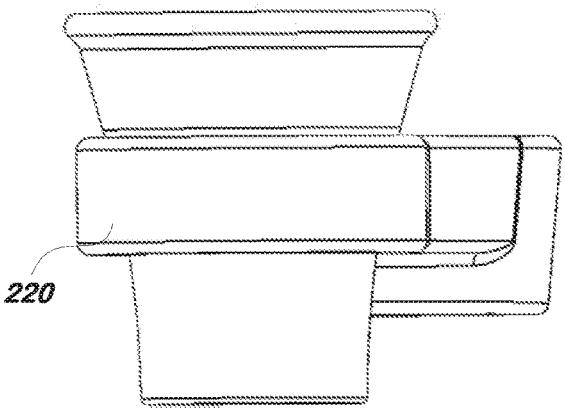
FIG. 24 shows a side view of the cup holder.
Figure 25:
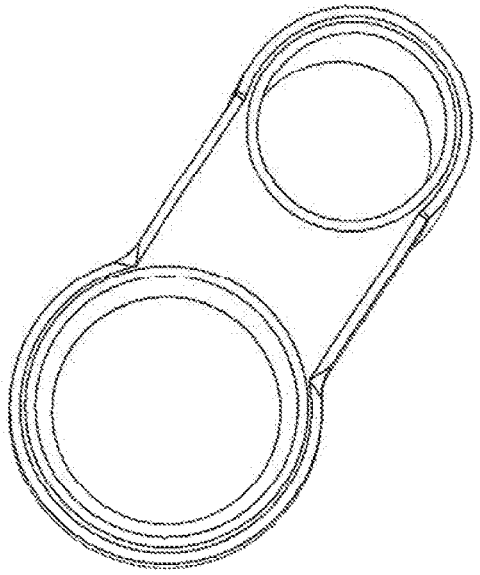
FIG. 25 shows a top view of the cup holder with the cup removed.

A smaller cup holder 220 can be slid up a leg of the chair, and depending upon where placed, can allow for stacking of the chair while the holder 220 is installed as shown in FIG. 22. The holder 220 includes a hole 222 which slides over the leg and is made from a plastic or elastomeric material to allow for sliding but to remain secure once in place. This holder 220 is especially useful for communion cups 221 and the like which are rather small.

Figure 26:
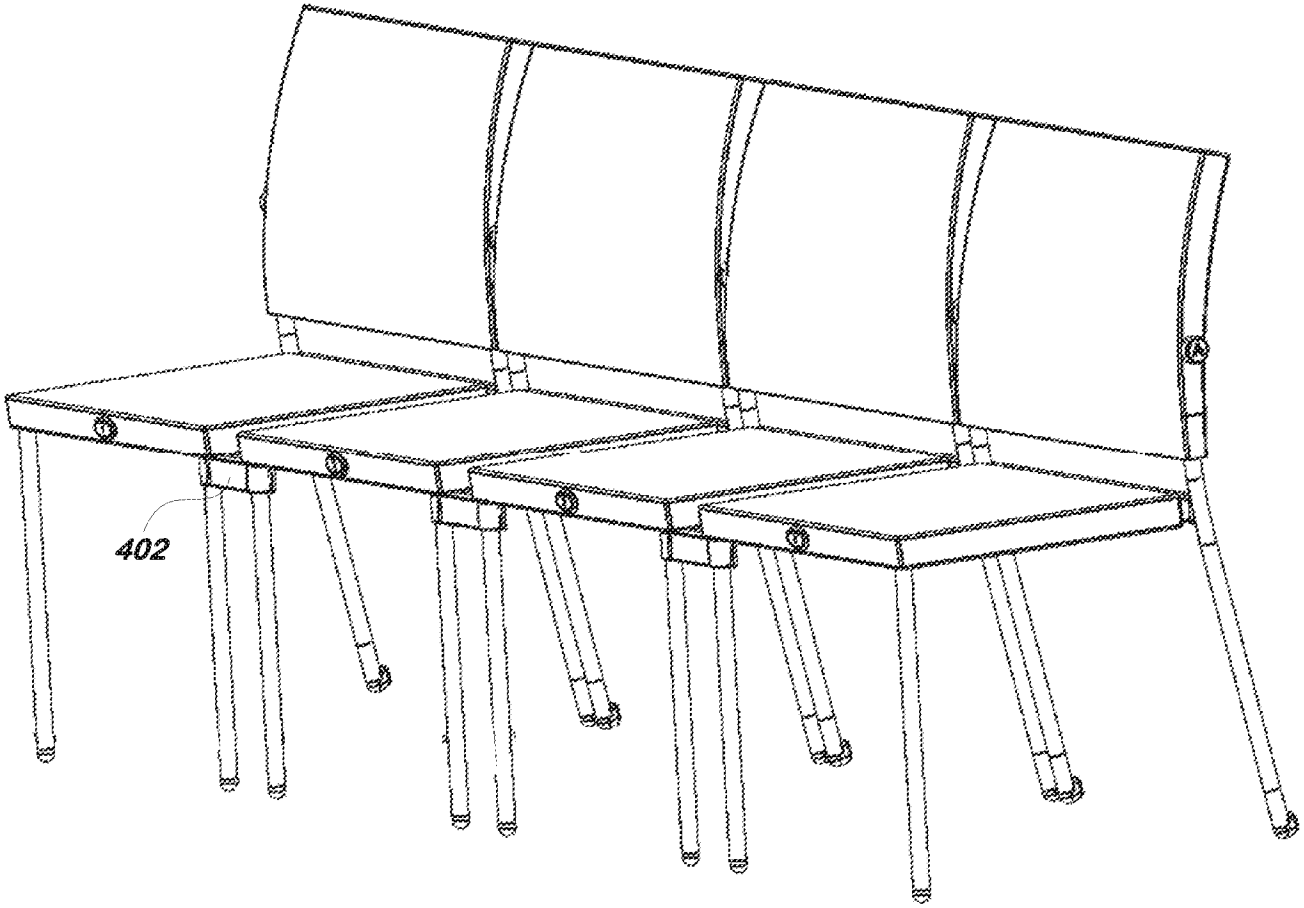
FIG. 26 shows four of the chairs of FIG. 1 connected and interlocked in a row.
Figure 28:
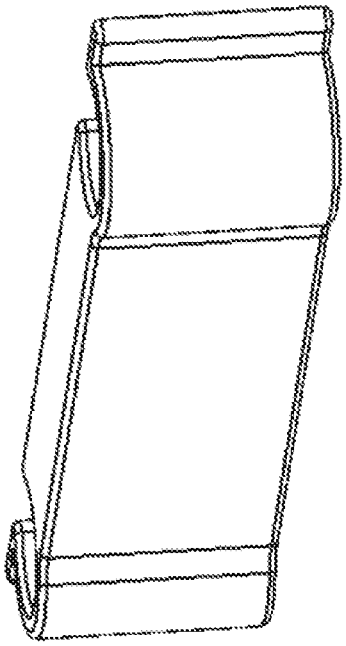
FIG. 28 is a perspective view of the front leg connector shown in FIG. 26.
Figure 29:
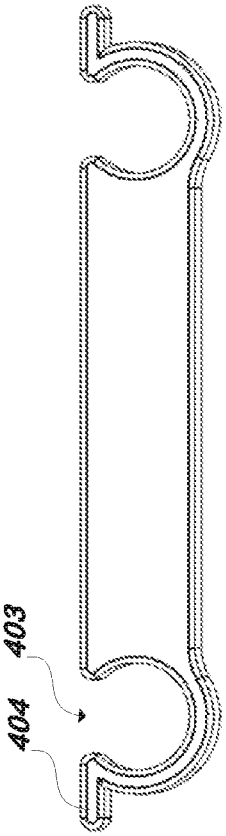
FIG. 29 is a top view of the front leg connector shown in FIG. 26.
Figure 27:
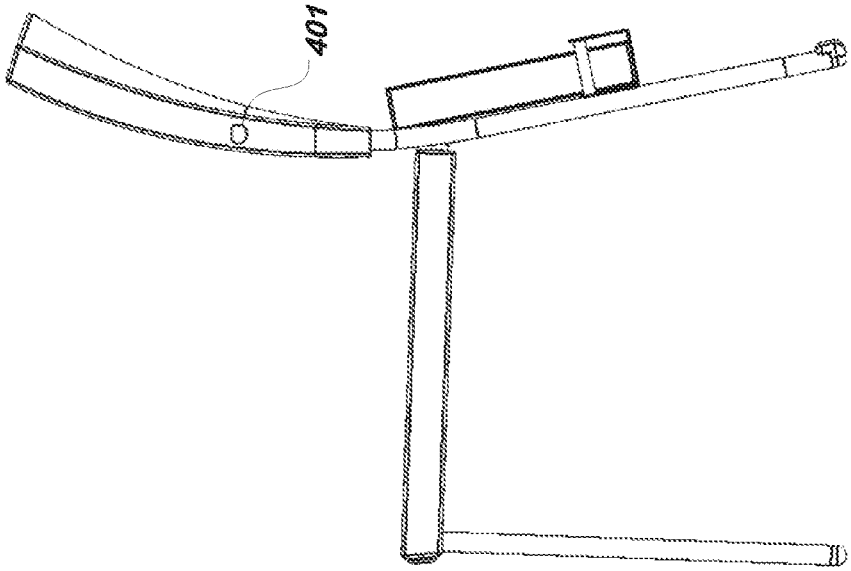
FIG. 27 shows a left side view of the chair of FIG. 1 with a book holder thereon.

FIG. 26 provides for a number of chairs connected together in a row. The chair is provided with right 400 (FIG. 1) and left 401 (FIG. 27) connectors. Generally, the left 401 connector is generally of a nail head configuration and the right 400 connector slides over the nail head to inhibit lateral movement apart of the chairs. Front connector 402 is provided to control the front leg spacing between adjacent chairs. Generally, this connector is of a plastic material which may be rigid, semi-rigid or elastomeric. The C shaped ends 403 snap onto the legs to allow for easy insertion over the legs and secure clamping. Tabs 404 allow for easy removal of the connector 402. The spacing between the C shaped ends 403 can be adjusted based on the desired row curvature with longer spacing providing for straight rows whereas shorter spacing provides for curved rows because the front legs would be pulled closer together.

Thus, the foregoing system provides for injection molding of foam around a support frame which already includes legs of the chair assembled thereto, the mold allows portions of the frame (e.g. legs) to exit the mold and remain free from (e.g. without) foam thereon. This allows the legs/frame to be finished with the powder coating, paint or other finish and the foam to then be injection molded around the frame. Very minimal post molding processing is required to finish the chair, for example, after both the seat and back are molded in foam and removed from the mold, the chair halves are pressed together in press fit engagement and the upholstery cover is added. In contrast, many seats presently available utilize a foam slab on a rigid plate which is upholstered and then secured to the frame, e.g. with screws. Thus, in the present case, the legs are already secured to the frame/seat support structure prior to adding the foam.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A method of manufacturing a chair comprising:

providing a first frame having rear legs and a back support portion;

providing a second frame having front legs and a seat support portion;

inserting the first frame into a first mold portion such that the rear legs extend out of the first mold portion and the back support portion of the frame is contained within the mold;

inserting the second frame into a second mold portion such that the front legs extend out of the second mold portion and the seat support portion of the frame is contained within the mold;

introducing foam into the first and second mold portions;

removing the first and second frames from the respective molds and securing the first and second frames together.

2. The method of claim wherein the first mold portion has a parting line separating two portions of the first mold portion and when closed the rear legs extend out an opening defined by a channel in each of the two portions of the first mold portion.

3. The method of claim 1, wherein the second mold portion has a parting line separating two portions of the second mold portion and when closed the front legs extend out holes in only one of the two portions of the second mold portion.

4. The method of claim 1, wherein one of the first or second mold portions includes movable protrusions which protrude into the cavity of the one of the first or second mold portions and are moveable and further comprising: moving the moveable protrusions into engagement with a receiver in one of the first or second frames to inhibit foam from entering the receiver.

5. The method of claim 1, wherein the first and second mold portions are configured to close to contain a portion of the frame and further comprising;

a hole in at least one of he first and second mold portions and configured to receive foam therein;

one or more openings in the each of the first and second mold portions configured to allow two of the one or more legs to extend through the one or more openings and out the mold such that the mold seals around the two of the one or more legs.

6. The method of claim 1, wherein securing the first and second frames together includes press fitting.

7. The method of claim 6, wherein the press fitting includes press fitting a receiver and a protrusion together, the receiver located in one of the first or second frames and the protrusion located in the other of the first or second frames.

8. The method of claim 1, wherein the second frame is formed at least in part by welding together at an attachment point two pieces which make up the front leg portion and seat support, the attachment point being located inside a cavity of the second mold portion such that the attachment point is embedded in the foam.

9. The method of claim 1, wherein the second frame is formed at least in part by welding together at an attachment point two pieces which make up the front leg portion and seat support, the attachment point being embedded in the foam.

10. The method of claim 1, wherein the backrest support portion is formed at least in part from two bent tubes, each bent tube including one of the rear legs and being continuous from inside the foam to outside the foam.

11. The method of claim 1, further comprising:

one or more openings of the first mold portion are defined by two pairs of channels, one of the channels of each of the two pairs of channels positioned on the first mold portion and one of the channels of each of the two pairs of channels positioned on the second mold portion such that when the first and second mold portions are closed, the channels align to form two openings each configured to allow one of the one or more legs to extend there through.

* * * * *